US005926863A

United States Patent [19]

Arita et al.

[11] Patent Number: 5,926,863

[45] Date of Patent: Jul. 27, 1999

[54] LOW FLUSH VOLUME TOILET

[75] Inventors: Kinya Arita; Ryoichi Tsukada; Shinji Shibata, all of Kitakyushu, Japan

[73] Assignee: Toto LTD., Kitakyushu, Japan

[21] Appl. No.: 08/786,911

[22] Filed: Jan. 22, 1997

Related U.S. Application Data

[63] Continuation of application No. 08/453,491, May 30, 1995, abandoned, which is a continuation of application No. 08/222,929, Apr. 5, 1994, abandoned.

[30] Foreign Application Priority Data

Apr. 6, 1993 [JP] Japan ..... 5-79453

[51] Int. Cl.[6] ..... E03D 11/08

[52] U.S. Cl. ..... 4/425; 4/421

[58] Field of Search ..... 4/425

[56] References Cited

U.S. PATENT DOCUMENTS

| | | | |
|---|---|---|---|
| Re. 18,065 | 5/1931 | Tilden | 04/425 |
| 0,237,036 | 1/1881 | Meyer | 4/425 |
| 0,244,893 | 7/1881 | Hellyer | 4/421 |
| 1,362,062 | 12/1920 | Tilden | 4/425 |
| 1,947,439 | 2/1934 | Crane et al. | 4/425 |
| 1,970,799 | 8/1934 | Gavin et al. | 4/425 |
| 2,066,883 | 1/1937 | Groeniger | 4/425 |
| 2,529,632 | 11/1950 | Russell et al. | 4/422 |
| 3,131,402 | 5/1964 | Roberts | 4/417 X |
| 4,145,776 | 3/1979 | Crosby et al. | 4/425 |
| 4,197,599 | 4/1980 | Tsai | 4/420 X |
| 5,054,133 | 10/1991 | Pickerrell et al. | 4/425 X |

FOREIGN PATENT DOCUMENTS

| | | |
|---|---|---|
| 63-91574 | 6/1988 | Japan . |
| 2-194225 | 7/1990 | Japan . |
| 3-62170 | 6/1991 | Japan . |

OTHER PUBLICATIONS

English language abstract of Japanese Patent Laid–Open Publication No. 2–194225, dated Jul. 31, 1990.

*Primary Examiner*—Robert M. Fetsuga
*Attorney, Agent, or Firm*—Finnegan, Henderson, Garrett & Dunner, L.L.P.

[57] ABSTRACT

A water-closet bowl which comprises a bowl part provided with a wash water delivery opening on the wall surface; a substantially inverted U-type trap water discharge channel formed adjacent to the bottom of the bowl part and communicating with the bowl part through the inflow opening at the bottom; a tank for storing wash water provided at the rear, upper portion of the bowl part and having a discharge opening at the bottom; a wash water-distributing part provided substantially just under the discharge opening of the tank and used for receiving the wash water from the tank and distributing it; a rim water path formed on the periphery at the upper end of the bowl part; a rim part having a plurality of wash water injection holes provided in communication with the rim water path; a first water channel communicating between the wash water-distributing part and the wash water delivery opening; and a second water channel communicating between the wash water-distributing part and the rim water path.

16 Claims, 8 Drawing Sheets

LOW FLUSH VOLUME TOILET

This is a continuation of application Ser. No. 08/453,491, filed May 30, 1995, now abandoned, which is a continuation of Ser. No. 08/222,929, filed Apr. 5, 1994, now abandoned.

Field of the Invention

The present invention relates to a toilet or water-closet bowl, and more particularly to a water-closet bowl which allows wash water to be saved.

BACKGROUND OF THE INVENTION

The water-closet bowl comprises a bowl part in the form of a bowl for receiving and storing sewage therein and an inverted U-type trap discharge channel provided in communication with the bottom of the bowl. Further, on the upper, rear portion of the bowl part is provided a low tank for storing wash water supplied to the bowl part. The amount of water which enables the bowl part to be washed and, at the same time, sanitary sewage to be completely discharged by causing the siphoning action in the trap discharge channel is required. The required amount of wash water, which is different depending upon the size, shape and application purpose of the water-closet bowl, is usually approximately 13 liters each time the toilet is flushed.

Hereupon, saving the amount of wash water for a water-closet bowl has recently come to be demanded from the point of view of energy conservation. Moreover, making a low tank for storing wash water smaller in size and designing the position of installation of the low tank so as not to project as far upwardly as possible from the upper end of the bowl part as far as possible are demanded from the viewpoints of a smaller space for installation and a design.

As the construction for supplying wash water into the bowl part, a rim injection system is known in which a water path (rim water path) is formed within a rim part provided on the peripheral portion at the upper end of the bowl part, and a plurality of wash water injection holes are provided so that they communicate with the rim water path and the direction of the injected wash water is directed to the inner wall surface of the bowl part. Further, a so-called wash-down system is known in which, utilizing the head of water from the low tank, the wash water flows down from the low tank directly into the bowl part to flush the sewage therein. Also, a so-called siphon jet system is known in which wash water is spouted toward the inflow opening of the trap discharge channel provided at the bottom of the bowl part to produce the siphoning action in a short time.

The rim injection system has an advantage in that adjustment of the direction and diameter of the wash water injection hole enables the flow of the wash water in the bowl part to produce a turning force relatively easily, thereby permitting the sewage within the bowl part to be surely discharged while the inner wall of the bowl part is being washed. However, it has a disadvantage in that since the wash water is spouted from a number of injection holes provided along the rim part, the loss in energy is large before the jet of the wash water occurs and, therefore, the potential energy of the wash water stored in the low tank is not effectively be used. This makes the saving of the wash water in the case of the rim injection system difficult, and in the case where the amount of water is reduced, the position of installation of the low tank must be made higher.

In the wash-down system, since the wash water flows down from the low tank directly into the bowl part, the loss in energy is small and sewage can be discharged with a smaller amount of wash water. However, this system has disadvantages in that the sound produced when the wash water flows down is great and, because of the narrower surface of the accumulated water stored in the bowl part, it is easy for an offensive smell to occur and for sewage to stick to the inner surface of the bowl.

Further, while the siphon jet system has an advantage in that the noise at the time of washing is low, there is the problem of a large amount of wash water being necessary to sufficiently wash the interior of the bowl and completely discharge the sewage therein.

For this reason, an attempt has been made to combine the rim injection system and the siphon jet system to save the amount of wash water and to increase the washing effect (for example, JP-A Hei-2-194225, Japanese laid-open utility model publications Sho-63-91574 and Hei-3-62170).

However, in such a combined construction of the rim injection system and siphon jet system as known in the past, the water channel communicating with the rim water path and the water channel communicating with the jet water path originate from a common water channel, and such a common water channel branches off into the water paths on the way into the bowl, or the jet water path branches off from the rim water path. This results in many bent points of the water path and the longer jet water path, so that the wash water is made to produce a great loss in energy while it passes through the jet water path. Moreover, there is a problem in that the flow of the wash water contracts, is turbulent or the like at the positions where the water path branches, thereby also wasting the potential energy of the wash water in such positions.

Thus, with the conventional combined construction as mentioned above, it is difficult to make the low tank smaller in size and the position of installation thereof lower in height.

SUMMARY OF THE INVENTION

It is an object of the invention to provide a water-closet bowl which inherently reduces the amount of the supply of wash water without making the position of installation of the low tank high, and which allows an increase in the washing effects.

It is a further object of the invention to provide a water-closet bowl which permits the noise produced at the time of washing to be reduced.

In order to achieve the above-mentioned objects of the invention, a water-closet bowl according to the invention comprises:

- a bowl part provided with a wash water delivery opening on the wall surface;
- a substantially inverted U-type trap discharge channel formed adjacent to the bottom of the bowl part and communicating with the bowl through an inflow opening at the bottom;
- a tank for storing wash water provided at the rear and upper portion of the bowl part and having a discharge opening at the bottom;
- a wash water-distributing part provided in a position substantially just under the discharge opening of the tank and used for receiving and distributing the wash water from the tank;
- a rim water path formed on the periphery at the upper end of the bowl;
- a rim part having a plurality of wash water injection holes provided in communication with the rim water path;

a first water channel communicating between the wash water-distributing part and the wash water delivery opening; and a second water channel communicating between the wash water-distributing part and the rim water path.

Further, according to a preferable form of the invention, the first and second water channels branch from the wash water-distributing part and in directions opposite of one another with the center line of the bowl part between the first and second water channels.

Moreover, according to a preferable form of the invention, the water discharge opening of the tank opens directly into the wash water-distributing part.

Further, according to a preferable form of the invention, the first and second water channels communicate so that they form a substantially U-shaped smooth curve through the wash water-distributing part.

Moreover, according to a preferable form of the invention, the wash water delivery opening is provided at the rear, upper portion of the bowl part and in the position shifted to one side from the center line of the bowl part.

In addition, according to a preferable form of the invention, the opening area of the wash water delivery opening is over two times larger than the total opening area of the plurality of wash water injection holes.

Further, according to a preferable form of the invention, the ratio of the opening area of the wash water delivery opening to the total opening area of the plurality of wash water injection holes is approximately 7:3.

In addition, according to a preferable form of the invention, the wash water delivery opening is provided in the position near the lowermost end edge of the rim part.

Further, according to a preferable form of the invention, the wash water delivery opening opens in the direction tangential to the concentric circle of said bowl part.

Moreover, according to a preferable form of the invention, the wash water delivery opening is provided at the bottom of the bowl part toward the inflow opening of the trap water discharge channel.

In addition, the wash water delivery opening opens in the direction shifted to one side with respect to the vertical center line of the inflow opening of the trap discharge channel.

BRIEF DESCRIPTION OF DRAWINGS

Other objects and aspects of the invention will become apparent from the following description of embodiments with reference to the accompanying drawings in which.

Preferred Embodiment of the Invention

Figure 1:
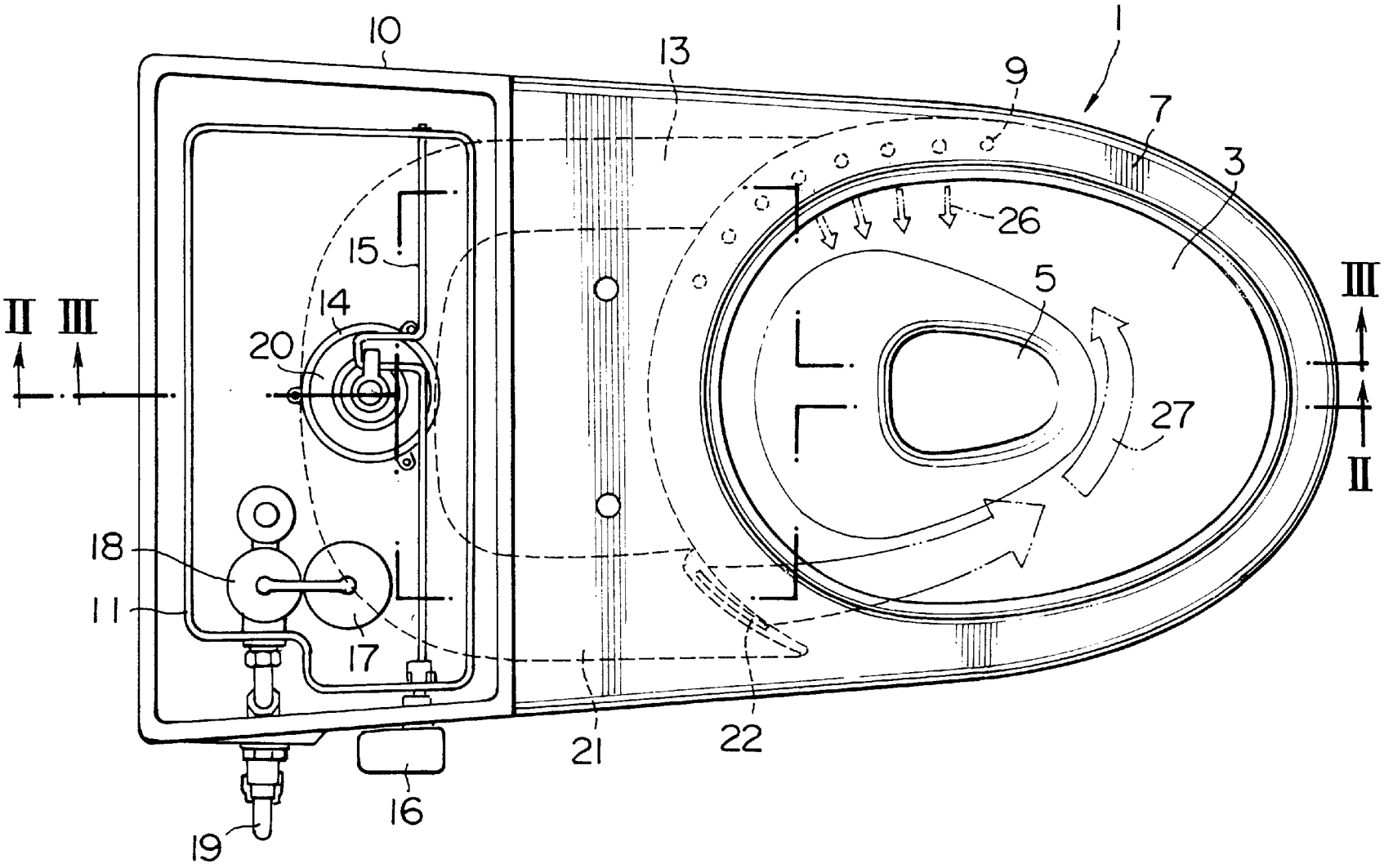
FIG. 1 is a plan view showing an embodiment of a water-closet bowl according to the invention.
Figure 2:
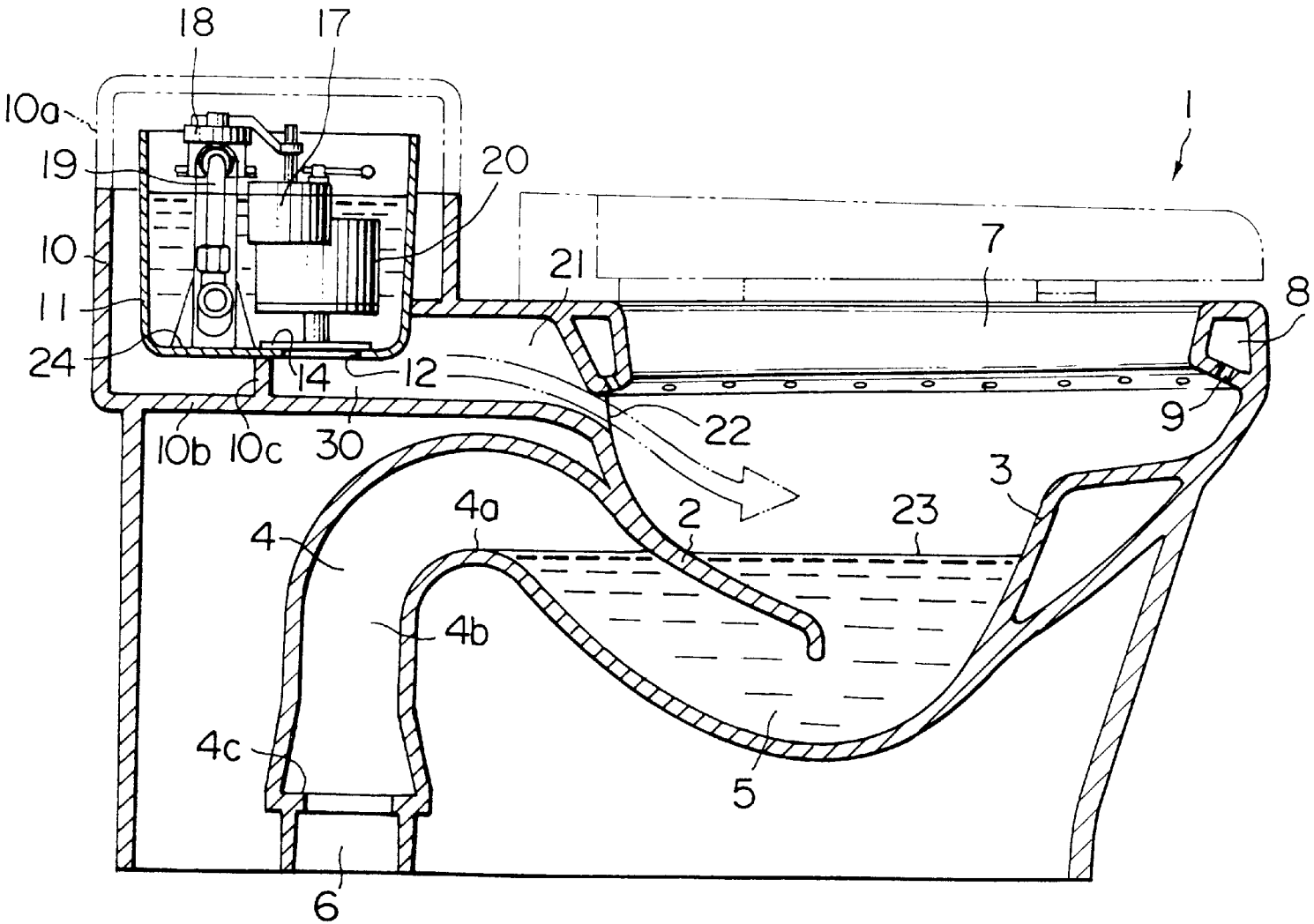
FIG. 2 is a longitudinal sectional view taken along line II—II of FIG. 1.

As shown in FIGS. 1 to 4, a water-closet bowl (hereinafter referred to as a bowl) 1 according to the invention comprises a bowl part 3 in the form of a bowl for receiving and storing sewage; a substantially inverted U-type trap discharge channel 4 defined by the bowl part 3 and a bulk-head 2 and communicating with the bowl part 3 by way of an inflow opening 5 at the bottom of the bowl part 3; and a rim part 7 formed so as to enclose the peripheral edge at the upper end of the bowl part 3.

The rim part 7 has a cavity in the interior thereof and is formed with a rim water path 8 through which wash water flows. Further, the rim part 7 is provided with a plurality of wash water injection holes 9 substantially on the circumference thereof. These wash water injection holes 9 are vertically provided in a circle at suitable intervals over the entire periphery of the rim water path 8.

The trap discharge channel 4 is formed so that the discharge channel 4*b* at the downstream side of a curved weir 4*a* is in the form of a substantially straight pipe, and a restriction 4*c* and an outlet 6 are provided at the lower end of the discharge channel 4*b*. The restriction 4*c* is such that the discharge channel 4*b* is reduced in its inner diameter in the direction of intersecting the pipe wall at a right angle, thereby permitting the production of a siphoning action at an early stage and an increase in the flow velocity to be planned.

At the rear, upper position of the bowl part 3 is provided a tank-accommodating chamber 10 in the form of a hollow box, in which a low tank 11 for storing wash water is housed. The tank-accommodating chamber 10 is integrally formed with the bowl part 3 and the space communicating with the bowl part 3 is formed under the tank-accommodating chamber 10.

The low tank 11 has a dimension of width which allows for the accommodation of the low tank in the tank-accommodating chamber 10, and at the same time, has a height which allows for the complete accommodation in the interior thereof when a cover 10*a* is fitted to the tank-accommodating chamber 10.The cover 10*a* for the tank-accommodating chamber 10 preferably has such a height that it does not protrude from the bowl part 3 so much from the design point of view of the bowl 1. For this reason, the low tank 11 is substantially in the form of a long rectangle in the same direction as the width of the bowl 1 based on the demand of ensuring the required amount of storage.

On the bottom of the low tank 11 is provided a substantially circular discharge opening 12, on which a discharge valve 14 is disposed to close the discharge opening 12. On the discharge valve 14 is connected a float 20, to the upper end of which a lever 15 is fitted to perform the operations of opening and closing the discharge valve 14. One end of the lever 15 protrudes through the tank-accommodating chamber 10, and a handle 16 for operation of the lever 15 is mounted on the protruding portion thereof. Further, there is provided a mechanism for automatically supplying water into the low tank 11 when the wash water within the low tank 11 is used, and for automatically stopping the supply of water when water accumulates up to a certain level. In the present embodiment, a widely known mechanism is used which includes a ball tap 18 adapted to automatically stop the water supply due to the buoyancy of a float ball 17. Reference numeral 19 designates a water supply tube for supplying the wash water to the low tank 11.

The diameter of the discharge opening 12 of the low tank 11 was determined on the basis of the result of an experiment as described below. First, the diameter of the discharge opening 12 was changed to various values, and the upper limit of an operating force relative to the water level (200 mm and below) within the tank was studied. Hereupon, the operating force means the force which attempts to pull up the discharge valve 14 against a water pressure or the like.

Figure 6:
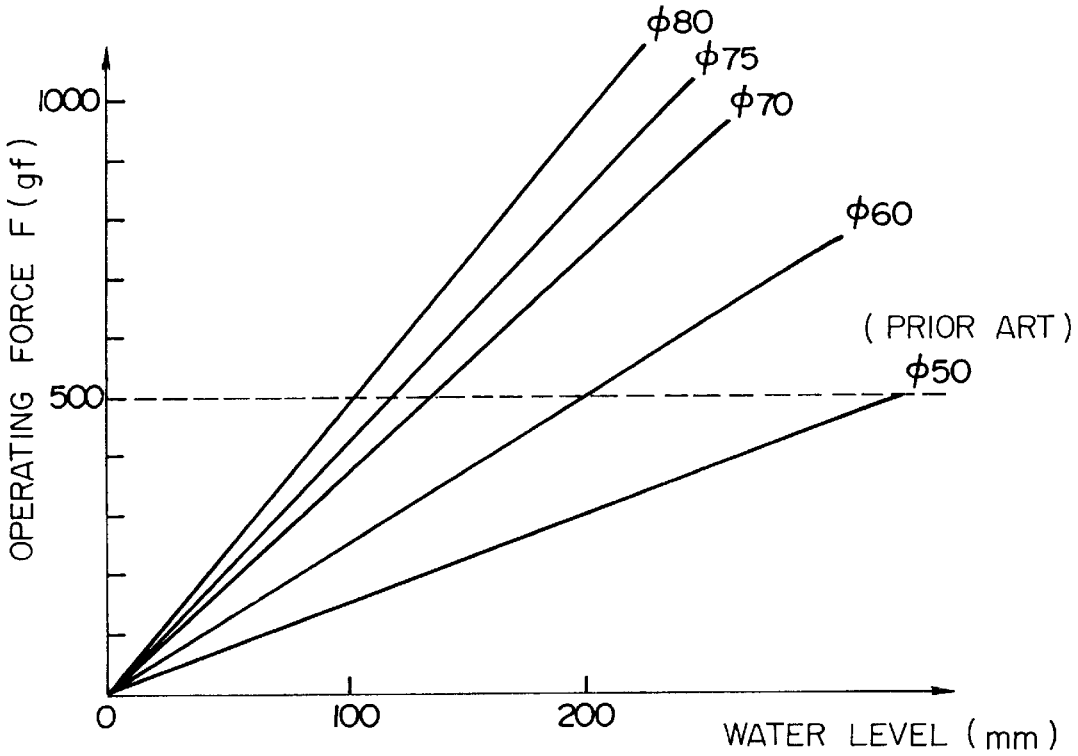
FIG. 6 is a graph showing the relation between the water level in a low tank and the operating force required for pulling up a discharge valve when the discharge opening of the low tank is changed.

As a result, it was found that if the water level is 100 mm, the discharge valve 14 having the diameter of the discharge opening 12 of 80 mm can be opened by a pulling-up force of the operating force 500 gf (Refer to FIG. 6).

In FIG. 6, the ordinate axis shows the operating force (unit: gf) and the abscissa axis shows the water level (unit: mm) of the low tank 11. ϕ50–ϕ80 means the fact that the bore diameters of the discharge valve 14 are 50 mm–80 mm.

Next, the lower limit of the water-stopping force relative to the diameter of the discharge opening 12 was studied by changing the operating force to various values in the range of 500 gf and below. Hereupon, the water stopping force means the force which attempts to keep the discharge valve 14 in a pressed state against the above-mentioned operating force.

As a result, it was found that the diameter of the discharge opening 12 is required to be 80 mm or below in order to ensure the force of approximately 300 gf, which is an optimum operating force, and to provide a sufficient water-stopping force of 1.2 g/mm or more (Refer to FIG. 7).

Figure 7:
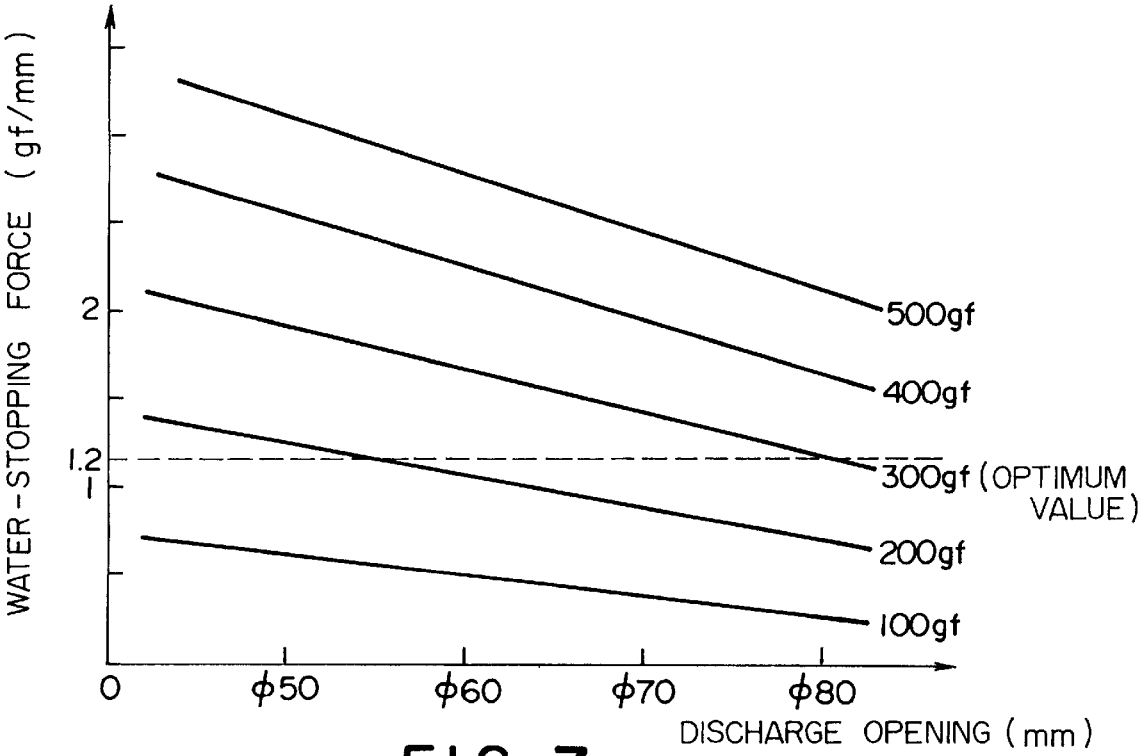
FIG. 7 is a graph showing the relation between the diameter of the discharge opening of the low tank and the water stopping force which presses the discharge valve against the operating force when the operating force is changed.

In FIG. 7, the ordinate axis shows a water-stopping force (unit: gf/mm), and the abscissa axis of shows a bore diameter of the discharge valve 14 (unit: mm). 100 gf–500 gf designates the operating forces.

The above experiment shows that a suitable diameter of the discharge opening, which allows an effective washing to be performed without impairing the operating force of the valve and the water-stopping force, lies in the range of 60 mm–80 mm. It is added that, at present, the discharge openings 12 having diameters of 50 mm are generally widely used.

The low tank in the present embodiment having the diameter of the discharge opening 12 of 75 mm, the capacity of the tank of 6 liters and the water level of 110 mm was compared with the conventional one having the bore diameter of 50 mm, the capacity of the tank of 9 liters and the water level of 200 mm.

As a result, since the present embodiment has a diameter of the discharge opening 12 larger than the conventional one, the instantaneous flow rate amounted to 200 liters per minute in spite of the lowered water level, and increased 30% and more as compared with the conventional flow rate of 150 liters per minute. This shows that in the present embodiment, a sufficient performance of washing can be maintained in spite of the smaller tank capacity thereof.

On the bottom surface 10*b* of the tank-accommodating chamber 10 is provided a projection 10*c*, on which the bottom 24 of the low tank 11 is placed and housed within the accommodating chamber 10. This forms a space between the bottom 24 of the low tank 11 having the discharge opening 12 thereon and the bottom surface 10*b* of the tank accommodating chamber 10, and the space provides a wash water-distributing part 30 which receives the wash water from the low tank 11 and distributes it to two water channels as described below. Namely, the low tank 11 is disposed so that the discharge opening 12 opens directly into the wash water-distributing part 30 formed at the lower portion of the tank-accommodating chamber 10.

The wash water-distributing part 30 is disposed substantially on the center line L in the longitudinal direction of the bowl part 3 and has a dimension larger than the diameter of the discharge opening 12. The wash water-distributing part 30 communicates with a second water channel 13 defined by a smooth curve extending in one direction relative to the above-mentioned center line of the bowl part 3, and the second water channel 13 further communicates with a rim water path 8. Moreover, the wash water-distributing part 30 communicates with a first water channel 21 defined by a smooth curve extending in the direction opposite the above-mentioned second water channel 13 with the center line L between the first and second water channels. The first water channel 21 further communicates with a wash water delivery opening 22 provided at the rear and upper portion of the bowl part 3 and in the position shifted to one side (the side of the first water channel 21) of the center line L of the bowl part 3. As shown in the drawings, the first and second water channels 21 and 13 communicate with each other through the wash water-distributing part 30 so as to form a substantially U-shaped smooth curve, thereby reducing the resistance of the flow path.

The wash water delivery opening 22 is provided in a position near the lowermost end edge of the rim 7 and opens in the tangential direction of the concentric circle of the bowl part 3 so that a turning force is caused in the accumulated water 23 stored in the bowl part 3. The area of the wash water delivery opening 22 is determined so as to become over two times larger than the total opening area of the plurality of the wash water injection holes 9. An experiment showed that the case where the ratio of the respective amounts of the wash water discharged from the wash water delivery opening 22 and the wash water injection holes 9 is approximately 7:3 is preferable to produce the effective washing operation. Concretely, the respective opening areas are determined taking into consideration the forms, lengths and the like of the first and second water channels 21 and 13. In addition, the form of the wash water delivery opening 22 may be a rectangle, an ellipse or another arbitrary form if the opening area can be made larger.

With the above-mentioned construction, when the handle 16 is operated, the discharge valve 14 is lifted by way of the lever 15 which is linked to the handle, the wash water within the low tank 11 flows out of the discharge opening 12 directly into the wash water-distributing part 30 just under the discharge opening 12, and further flows from the wash water-distributing part 30 through the second water channel 13 and the rim water path 8 till it is supplied from the injection holes 9 into the bowl part 3. The flow of the wash water during such an operation is indicated by the arrow marks 25 and 26.

Simultaneously with this, the wash water within the low tank 11 flows from the discharge opening 12 directly into the wash water-distributing part 3 just under the discharge opening 12, further flows from the wash water-distributing part 30 through the first water channel 21 to the wash water delivery opening 22, and is supplied from the wash water delivery opening 22 into the bowl part 3. The flow of the wash water during such an operation is indicated by the arrow mark 27.

Figure 3:
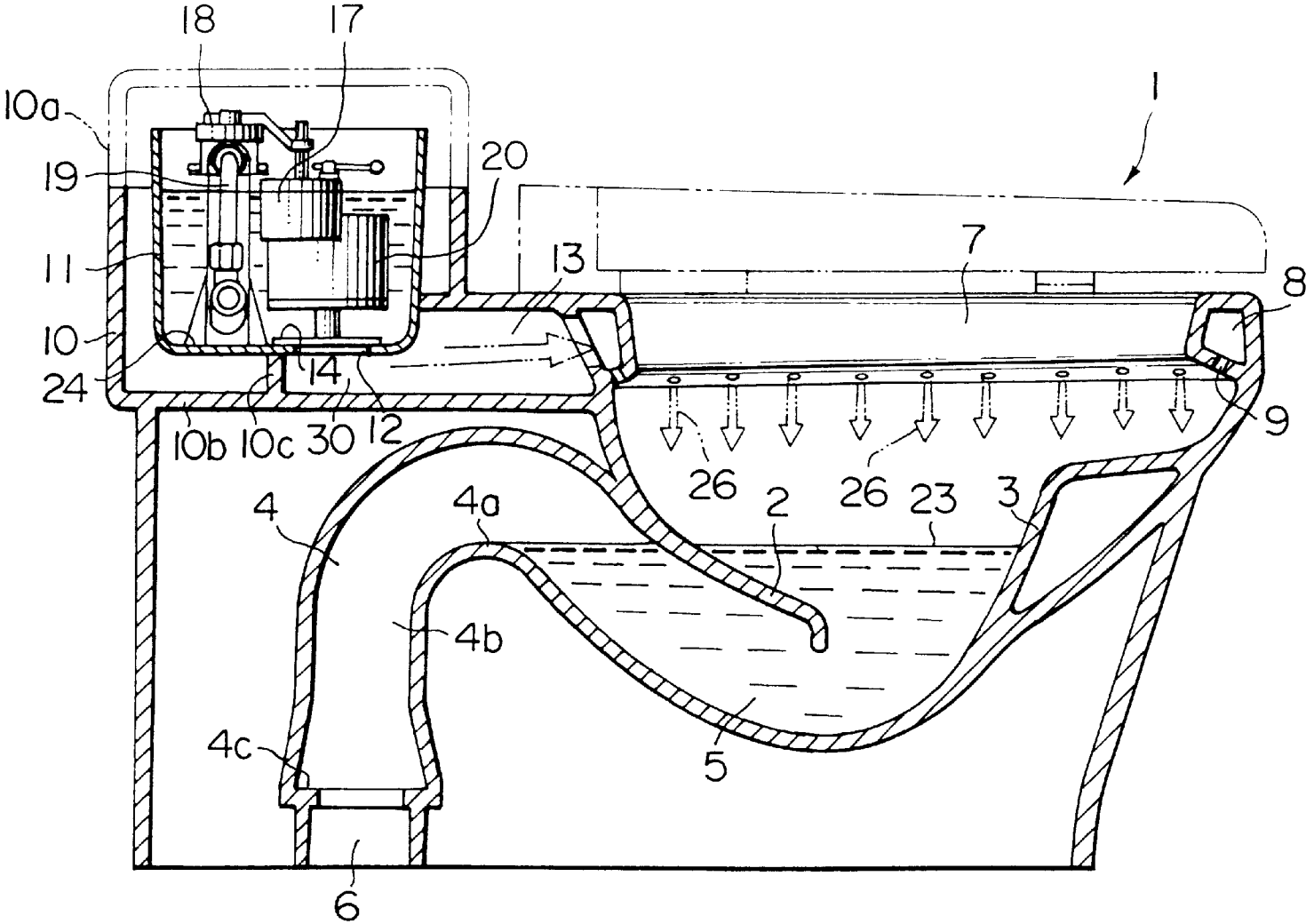
FIG. 3 is a longitudinal sectional view taken along line III—III of FIG. 1.
Figure 4:
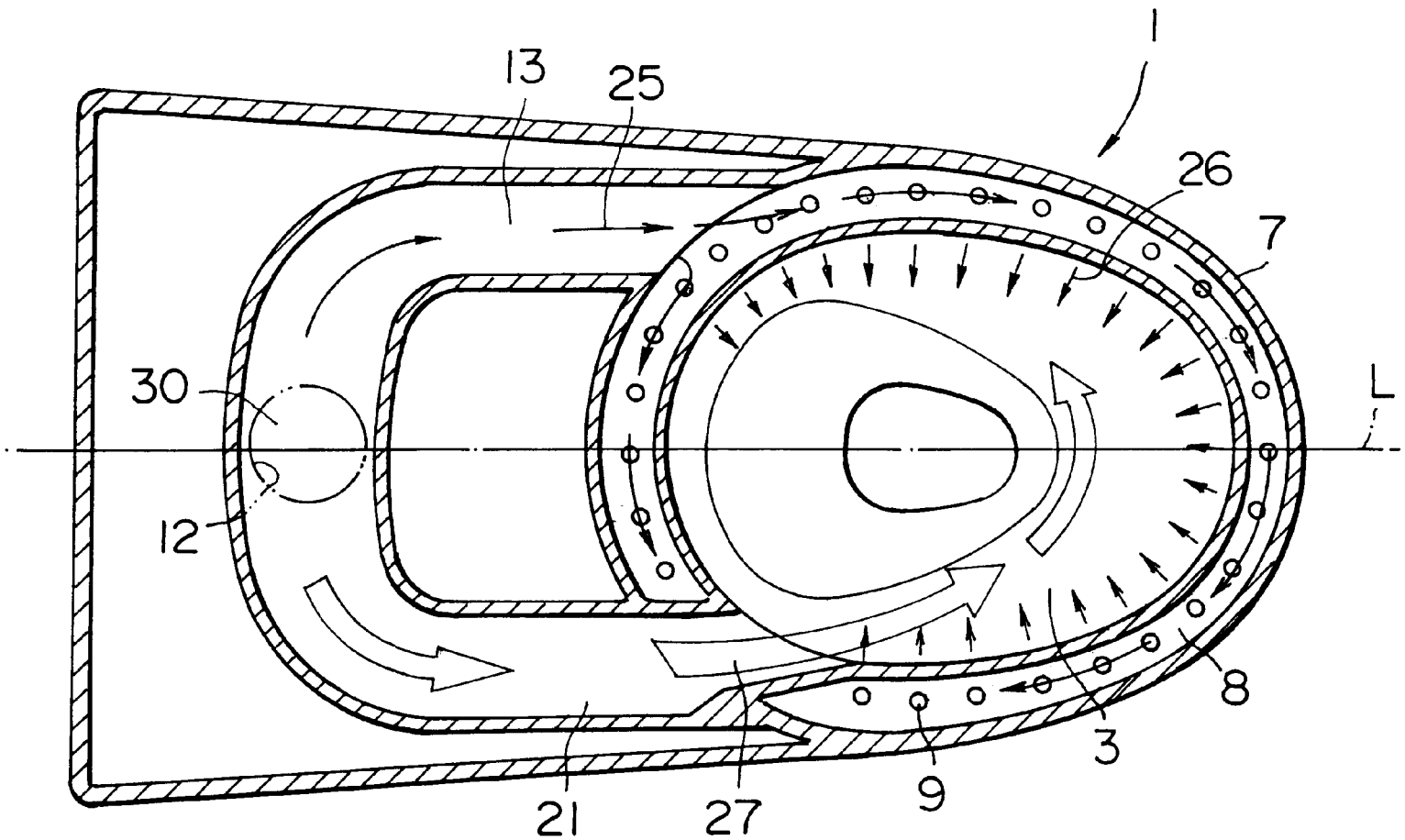
FIG. 4 is a sectional view of the water-closet bowl in FIG. 1 as viewed from above.
Figure 5:
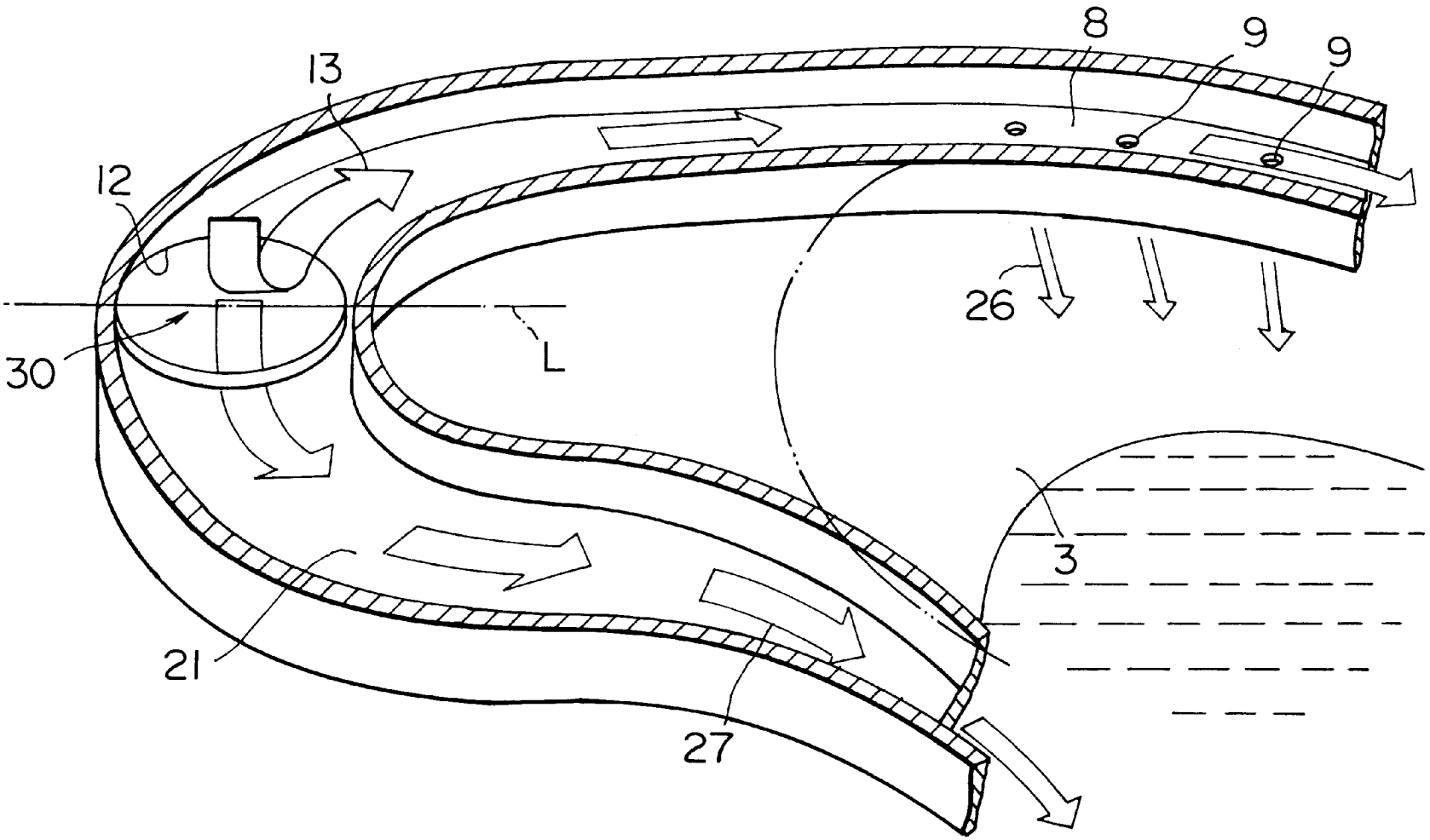
FIG. 5 is a fragmentary enlarged perspective view showing the construction of a wash water-distributing part, a first water channel and a second water channel.

In this case, the wash water from the injection holes 9 is vertically delivered into the bowl part 3 in the direction somewhat shifted from the center thereof due to the delivery pressure of the wash water, causing a spiral flow slightly (refer to FIG. 3). On the contrary, the opening 22 is directed to the direction of the concentric circle of the bowl part 3, and therefore, the wash water is delivered in the direction of the concentric circle of the bowl part 3 (refer to FIG. 4).

According to the present embodiment, the wash water within the low tank 11 flows from the discharge opening 12 directly into the wash water-distributing part 30 just under the discharge opening 12, and further flows to the first and second water channels 21 and 13 which come out from the wash water-distributing part 30 by way of the respective smooth flow paths, so that no contraction flow or turbulent flow is caused on the way, thereby permitting the loss in energy to be reduced to a great extent.

Further, since the discharge opening 12 opens directly into the wash water-distributing part 30, a greater value can be used for the dimension of the discharge opening 12 and, therefore, the total instantaneous amount of wash water can be made greater.

In addition, since the wash water-distributing opening 22 has an opening area two times larger than the total area of the wash water injection holes 9 and, at the same time, communicates directly with the wash water-distributing part 30 through the first water channel 21 formed by the smooth flow path, the amount of energy loss of the wash water as discharged from the wash water delivery opening 22 can be suppressed to a considerably small range. In addition, since an amount of wash water two times and more than that of the injection holes 9 is supplied from the wash water delivery opening 22, the wash water supplied from the wash water delivery opening 22 provides a strong turning force to the accumulated water 23 within the bowl part 3.

When the above-mentioned turning force is provided, the nearer the bottom the layer of the accumulated water 23 is, the more it is affected by the wall of the bottom and the less the peripheral speed thereof becomes, and, therefore, the nearer the bottom the water layer is, the smaller the radius of curvature of the flow becomes, whereby a spiral flow is produced in the accumulated water 23 in the direction to the center (radial direction) thereof.

As a result, the flow of the wash water is concentrated in the center of the accumulated water 23 and the wash water is forced into the inflow opening 5 which is an inlet of the trap.

This causes a rise in the water level within the bowl part 3 and, at the same time, the wash water is forcibly pushed into the trap discharge channel 4, so that the siphoning action is rapidly caused in the trap discharge channel 4, thereby performing a subsequent cleaning and discharging action.

Moreover, the wash water supplied to the rim water path 8 through the second water channel 13 is spouted from the wash water injection holes 9 toward the inner peripheral surface of the bowl part 3, and flows down to the accumulated water 23 while washing the wall surface of the bowl part. This completely washes the interior of the bowl part 3.

In this way, according to the present embodiment, the large instantaneous flow rate of the wash water is supplied from the wash water delivery opening 22 toward the accumulated water 23 in the bowl part 3 while the loss in the potential energy of the wash water is suppressed within the low tank 11, thereby enabling a strong spiral flow to be produced in the accumulated water 23; therefore, a little amount of wash water can be used and the siphoning action necessary for the discharge can surely be produced even if the potential energy is relatively small. This permits a smaller-sized low tank 11 to be planned, and simultaneously, the position of installation of the low tank 11 can be made lower, thereby allowing the low silhouette of the bowl 1. For example, the present invention permits the installation height of the bottom of the low tank 11 to be made lower than that of the upper surface of the rim part 7, so that the height from the floor surface, on which the bowl 1 is installed, to the upper surface of the low tank 11 comes to be small. Accordingly, the smaller-sized low tank and the low silhouette of the bowl can be planned, thereby allowing the space for installation of the bowl to be made smaller, and simultaneously, the external appearance thereof to be made into a preferable configuration.

In the present embodiment, the example, in which only one wash water delivery opening 22 is provided, is shown; however, a plurality of the wash water delivery opening 22 may be provided. Further, in the embodiment, the wash water delivery hole 22 is provided in the position shifted to one side of the center line L of the bowl 1; however, it can be provided on the center line L. In this case, it is necessary to deflect the opening direction of the wash water delivery opening 22 so that the wash water is supplied in the direction tangential to the concentric circle of the bowl part 3.

The present embodiment shows an example where the wash water injection holes 9 are vertically provided; however, the wash water injection holes may be provided so as to be directed to the direction inclined relative to the inner wall surface of the bowl part 3. This enables the spiral flow to be more easily produced by the water spouted from the wash water injection holes 9.

In addition, the present embodiment shows the example where the tank-accommodating chamber 10 is integrally formed with the bowl part 3; however, the tank-accommodating chamber 10 may be separately formed from the bowl part 3 and both may be combined.

Figure 8:
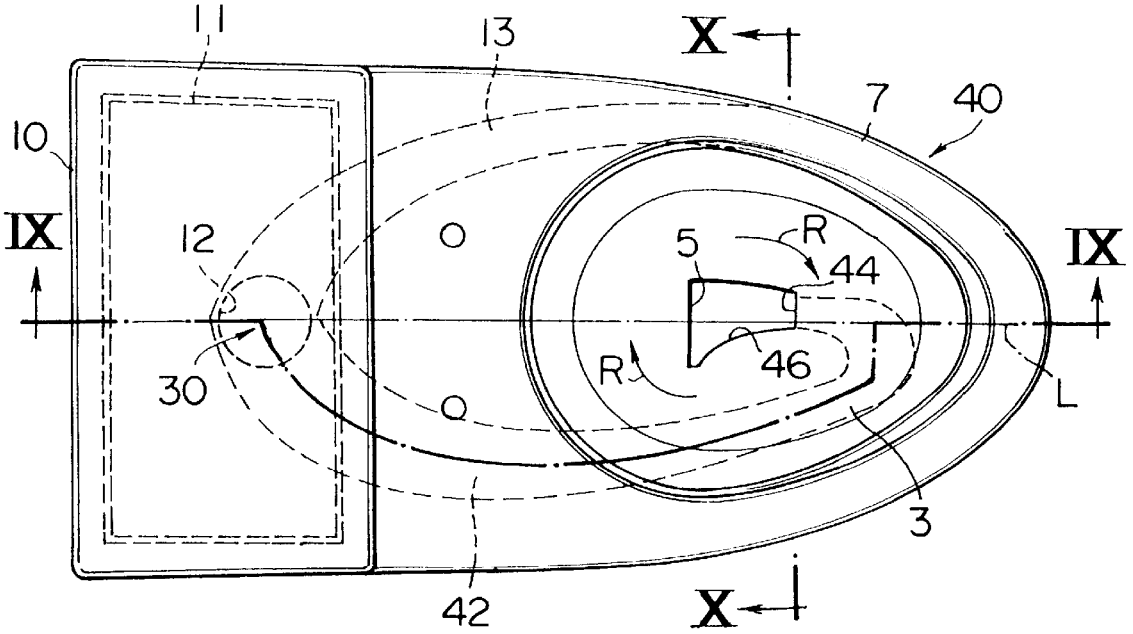
FIG. 8 is a plan view showing another embodiment of a water-closet bowl according to the invention.
Figure 9:
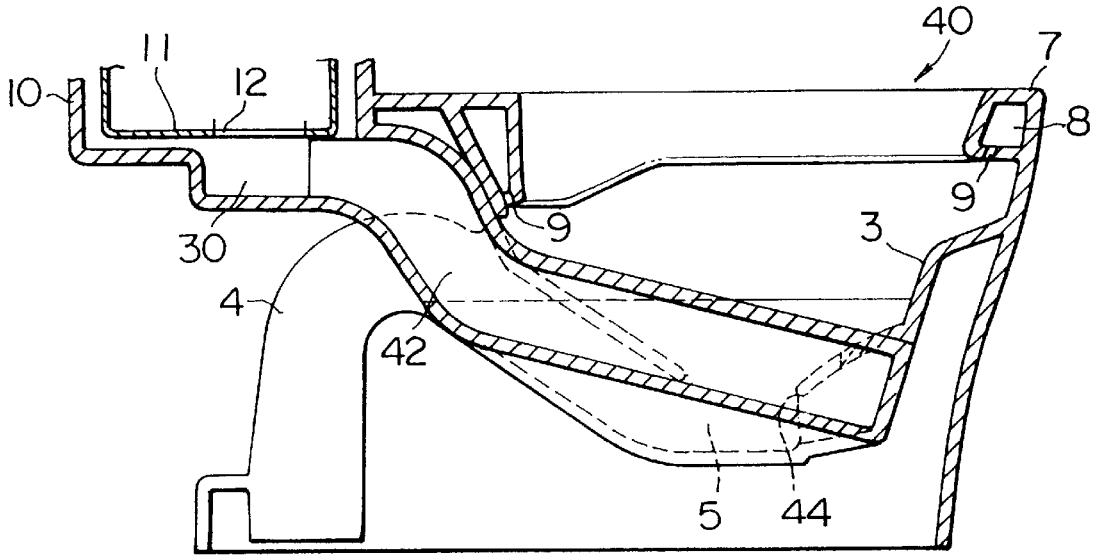
FIG. 9 is a longitudinal sectional view taken along line IX—IX of FIG. 8.
Figure 10:
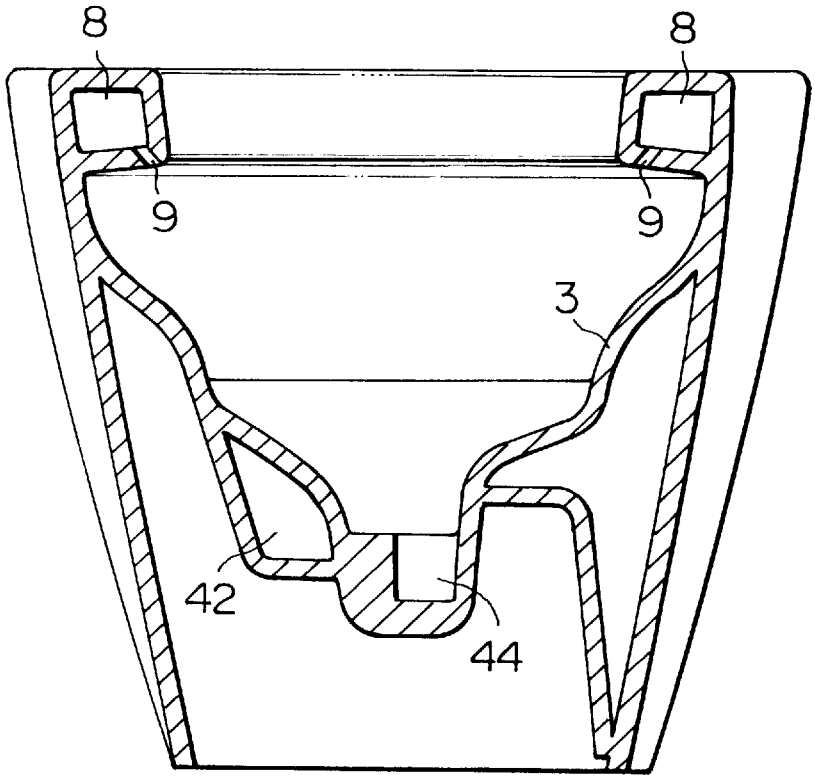
FIG. 10 is a cross sectional view taken along line X—X of FIG. 8.

Next, a second embodiment of the invention will be explained with reference to FIGS. 8 to 10.

A bowl 40 according to the second embodiment is different from the bowl 1 according to the first embodiment in that the wash water delivery opening is provided at the bottom of the bowl part toward the inflow opening of the trap water discharge channel. The same reference numerals in the first embodiment are affixed to the parts common to those in the first embodiment and the explanation thereof is omitted.

Also in the present embodiment, the wash water-distributing part 30 is provided in the position substantially just under the discharge opening of the low tank 11, similar to the first embodiment. The wash water-distributing part 30 communicates with the second water channel 13, which further communicates with the rim water path 8. On the other hand, the first water channel 42 extending in the direction opposite that of the second water channel 13 is formed with the center line L of the bowl 40 between the first and second water discharge channels. The first water channel 42 is formed so that it extends with a smooth curve from the rear, upper portion of the bowl part 3 to the front, lower portion of the bowl part 3 along the lateral surface of the bowl part 3, and the inlet side and outlet side of the first water channel communicate with the wash water-distributing part 30 and the jet hole 44, respectively. The jet hole 44 opens into the bottom of the bowl 3 toward the inflow opening 5 of the trap water discharge channel 4.

The first water channel 42 is made to have a larger diameter (for example, the diameter of 35 to 40 mm) to suppress the resistance of flow to a low value, and the radius of the bent portion also is made large. Further, it is preferable to design the first water channel 42 so that the flow velocity of the wash water spouted from the jet hole 44 amounts to 1.6 m/sec and more in order to effectively produce the siphoning effect by the wash water spouted from the jet hole 44.

In the present embodiment, the jet hole 44 opens in the direction shifted to one side (the right side in FIG. 10) with respect to the vertical center line of the inflow opening 5 of the trap discharge channel 4. This serves to reduce the noise at the time of washing, and, as shown in FIG. 8, the jet hole 44 opens in a shifted relation to the right with respect to the center line L of the bowl 40 in the case where the turning direction R of the wash water is the right direction as viewed from above the bowl 40. Further, at the outlet side of the jet hole 44 is provided a curved guide portion 46 so that the outflow path comes to be large in a smooth manner toward the inflow opening 5.

Making the jet hole 44 open toward the direction shifted to one side, as described above, enables the noise due to the inflow of air caused during the siphoning action (siphon breaking-off noise) to be reduced, and simultaneously, the difference between the maximum value and the minimum value can be made small, thereby permitting the noise caused at the time of washing to be usually suppressed to a low level.

Figure 11A:
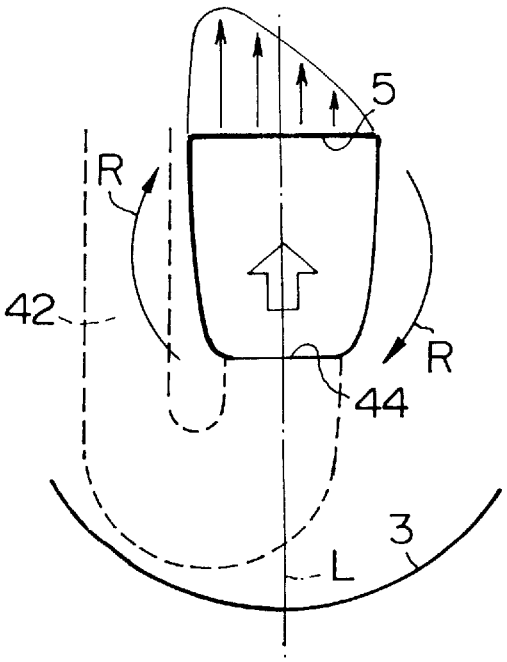
FIGS. 11 A and 11 B are explanatory views for explaining the distribution of the flow rate near the jet hole.
Figure 11B:
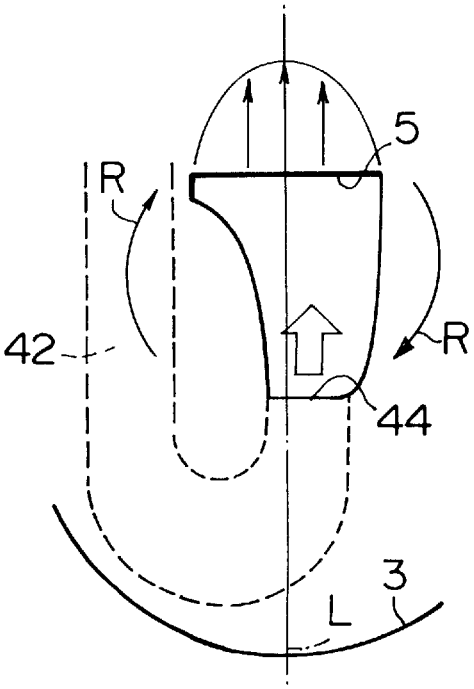

This reason will be explained below. As shown in FIG. 11, in the case where the jet hole 44 is not shifted to one side (FIG. 11A), the flow velocity near the right side of the inflow opening 5 is decelerated by the turning flow of the wash water within the bowl part 3 and comes to be low, and on the contrary, the flow velocity near the left side of the inflow opening 5 is accelerated by the turning flow and comes to be high. This makes the distribution of the flow velocity near the inflow opening 5 uneven, and it comes to be easy for air to enter from the right side of the inflow opening 5 and, at the same time, a turbulent flow occurs. As a result, it comes to be easy for air to enter during the siphoning action, and a relatively large noise occurs.

In the meantime, in the case where the jet hole 44 is shifted to the right (FIG. 11B), the velocity of the flow from the jet hole 44 is larger at the right side; however, it is compensated by the turning flow of the wash water and comes to be an uniform flow near the inflow opening 5. As a result, entering of air during the siphoning action is few and the end of the action is smoothly performed, thereby enabling the noise to be reduced.

Moreover, provision of the guide part 46 at the outlet side of the jet hole 44 makes the flow near the outlet side of the jet hole 44 smooth, thereby permitting the dispersion of the siphon breaking-off noise to be suppressed. Further, in the present embodiment, the jet hole 44 is shifted to the right; however, in the case where the direction of the turning flow comes to be reversed, the jet hole 44 is shifted to the left.

According to the present embodiment, the wash water within the low tank 11 flows down directly into the wash water-distributing part 30 passing through the discharge opening 12 of a relatively large diameter, similar to the first embodiment as described above, and subsequently, flows from the wash water-distributing part 30 to the first water channel 42 and the second water channel 13 which communicate with each other by the smooth flow path.

A large amount of the wash water which has passed the first water channel 42 is spouted from the jet hole 44 toward the inflow opening 5 of the trap discharge channel 4, thereby causing the siphoning action within the trap discharge channel 4. In the present embodiment, since the wash water to the jet hole 44 is supplied from the wash water-distributing part 30 directly through the first water channel 42, the resistance of the flow is small and the instantaneous flow rate spouted from the jet hole 44 can be made large. Accordingly, even if a little amount of the wash water is stored in a relatively low position, the siphoning action necessary for discharge of sewage can surely be produced.

In this way, the present embodiment permits the amount of use of the wash water to be reduced and the low silhouette to be planned, and simultaneously, permits the noise at the time of washing to be reduced.

What is claimed is:

1. A water-closet comprising:

a bowl including an upper end with a peripheral edge;

a substantially inverted U-type discharge channel formed adjacent to the bottom part of said bowl and communicating with the bowl through an inflow opening at the bottom of the bowl;

a tank for storing wash water provided at the rear, upper portion of the water-closet and having a discharge opening at a bottom of the tank;

a wash water-distributing part in a position substantially just under the discharge opening of the tank; the wash water-distributing part having a receiving end and at least two distributing ends with a wash water flow path between the receiving end and the distributing ends, and the water-distributing part being used for receiving and distributing wash water from the tank;

a rim water path formed on the peripheral edge at the upper end of the bowl;

a rim part having a plurality of wash water injection holes in communication with the rim water path and positioned lower than the discharge opening;

a first water channel communicating between the wash water-distributing part and the wash water delivery opening; and a second water channel communicating between the wash water-distributing part and the rim water path;

the first and second water channels branching from the wash water-distributing part so that the first and second water channels and the wash water-distributing part form a coplanar U-shape below the discharge opening.

2. A flush-type toilet as claimed in claim 1, wherein said wash water delivery opening is located at the rear, upper portion of said bowl at a position on one side of said bowl.

3. A flush-type toilet as claimed in claim 2, wherein the area of said wash water delivery opening is over two times larger than the total opening area of said plurality of wash water injection holes.

4. A flush-type toilet as claimed in claim 3, wherein the area of said wash water delivery opening to the total area of said plurality of wash water injection holes is such that the ratio of the delivery of the wash water from said respective openings is 7:3.

5. A flush-type toilet as claimed in claim 4, wherein said wash water delivery opening is near the lowermost edge of said rim.

6. A flush-type toilet as claimed in claim 4, wherein said bowl includes a generally circular interior surface and said wash water delivery opening opens in a direction tangential to said interior surface of said bowl.

7. A flush-type toilet comprising:

a bowl having a substantially inverted U-type discharge channel formed adjacent to the bottom portion of said bowl, said channel communicating with the bowl through an inflow opening at the bottom of said bowl, said bowl further including a wash water delivery opening for delivery of wash water to the interior of said bowl;

a tank for storing wash water provided at the rear, upper portion of said flush-type toilet and having a discharge opening at the bottom of said tank, said wash water delivery opening being located at the bottom of the interior of said bowl and opening in a direction toward said inflow opening of said inverted U-shaped water discharge channel;

said toilet including a substantially U-shaped wash water-distributing channel having a water receiving portion and two water distributing portions, said water receiving portion being the base portion of said U in said U-shaped wash water-distributing channel and said two water distributing portions being the two opposite leg portions of said U of said U-shaped wash water-distributing channel, said water receiving portion being positioned directly beneath said discharge opening of said tank, said water-distributing channel being disposed to receive and distribute wash water from said tank to said bowl;

said bowl including a rim at the upper edge of said bowl, said rim having a plurality of wash water injection holes;

a rim water path within said rim, said rim water path being in flow communication with said wash water injection holes, said holes being positioned lower than said discharge opening in said tank;

a first distributing portion of said U-shaped wash water-distributing channel being in flow communication with said wash water delivery opening; and a second distributing portion of said U-shaped wash water-distributing channel being in flow communication with said rim water path, wherein said first and second distributing portions of said U-shaped wash water-distributing channel lie on opposite sides of said bowl.

8. A water-closet bowl as claimed in claim 7, wherein said wash water delivery opening opens in the direction shifted to one side with respect to the vertical center line of said inflow opening of said trap discharge channel.

9. A flush-type toilet as claimed in claim 7, wherein said U-shaped wash water-distributing channel is comprised of a smooth, curved shape.

10. A flush-type toilet as claimed in claim 7, wherein said wash water delivery opening is located at the bottom of the interior of said bowl and opens in a direction toward said inflow opening of said inverted U-shaped water discharge channel.

11. A flush-type toilet as claimed in claim 10, wherein said wash water delivery opening opens in a direction to one side of said inflow opening of said inverted U-shaped discharge channel.

12. A flush-type toilet comprising:

a bowl having a substantially inverted U-type discharge channel formed adjacent to the bottom portion of said bowl, said channel communicating with the bowl through an inflow opening at the bottom of said bowl, said bowl further including a wash water delivery opening for delivery of wash water to the interior of said bowl;

a tank for storing wash water provided at the rear, upper portion of said flush-type toilet and having a discharge opening at the bottom of said tank;

said toilet including a substantially U-shaped wash water-distributing channel having a water receiving portion and two water distributing portions, said U-shaped wash water-distributing channel having a smooth, curved shape, said water receiving portion being the base portion of said U in said U-shaped wash water-distributing channel and said two water distributing portions being the two opposite leg portions of said U of said U-shaped wash water-distributing channel, said water receiving portion being positioned directly beneath said discharge opening of said tank, said water-distributing channel being disposed to receive and distribute wash water from said tank to said bowl, said first and second distributing portions of said U-shaped wash water-distributing channel lie on opposite sides of said bowl;

said bowl including a rim at the upper edge of said bowl, said rim having a plurality of wash water injection holes;

a rim water path within said rim, said rim water path being in flow communication with said wash water injection holes, said holes being positioned lower than said discharge opening in said tank;

a first distributing portion of said U-shaped wash water-distributing channel being in flow communication with said wash water delivery opening; and a second distributing portion of said U-shaped wash water-distributing channel being in flow communication with said rim water path.

13. A flush-type toilet as claimed in claim 12, wherein said wash water delivery opening opens in a direction to one side of said inflow opening of said inverted U-shaped discharge channel.

14. A flush-type toilet as claimed in claim 12, wherein said discharge opening has a diameter in the range of from 60 to 80 mm.

15. A flush-type toilet as claimed in claim 12, wherein the area of said wash water delivery opening is greater than two times the combined area of said wash water injection holes.

16. A flush-type toilet as claimed in claim 12, wherein the ratio of water volume from said wash water delivery opening to the combined water volume from all of said wash water injection holes is approximately 7:3.

* * * * *